United States Patent [19]

Norakidze et al.

[11] 4,453,148

[45] Jun. 5, 1984

[54] KEY SWITCH

[76] Inventors: Georgy G. Norakidze, ulitsa Lenina, 75, kv. 16; Ramaz M. Sakandelidze, ulitsa Lenina, 20, kv. 4; Eduard K. Sitnikov, Digomsky massiv, III kvartal, 35, kv. 45; Otar K. Khomeriki, ulitsa Pavlova, 2, kv. 13, all of Tbilisi, U.S.S.R.

[21] Appl. No.: 469,264

[22] Filed: Feb. 24, 1983

[51] Int. Cl.[3] ..... H01H 9/00

[52] U.S. Cl. ..... 335/205; 335/207

[58] Field of Search ..... 335/205, 206, 207, 153

[56] References Cited

U.S. PATENT DOCUMENTS

| | | | |
|---|---|---|---|
| 3,206,573 | 9/1965 | Anderson et al. | 335/207 |
| 3,701,064 | 10/1972 | Kinoshita et al. | 335/205 |

FOREIGN PATENT DOCUMENTS

| | | | |
|---|---|---|---|
| 1166948 | 4/1964 | Fed. Rep. of Germany | 335/205 |
| 409302 | 4/1974 | U.S.S.R. | 335/205 |

*Primary Examiner*—George Harris

*Attorney, Agent, or Firm*—Fleit, Jacobson, Cohn & Price

[57] ABSTRACT

The key switch comprises a housing with at least one permanent magnet accommodated therein, the magnet being rigidly connected with the key and adapted to act, when the key is displaced, onto a switching member secured in the housing. Mounted in the housing intermediate the key and the magnet are means for retaining the key in its initial position, including a plate of a ferromagnetic material. The housing further accommodates the means for returning the key into the initial position, including at least one plate of a ferromagnetic material, arranged in the direction of the motion of the key with a gap relative to the permanent magnet and defining with the plate of the key-retaining means a magnetic circuit. The length of this at least one plate of the means for returning the key in the direction of the motion of the key is short of the sum of the value of the maximum displacement of the key and the extent of the permanent magnet in this direction.

4 Claims, 3 Drawing Figures

KEY SWITCH

FIELD OF THE INVENTION

The invention relates to electric engineering, and more particularly it relates to switches of the key type intended for making or breaking electric circuits, and can be utilized for manual input of information into various communication and computation apparatus, into printing devices and automatic control systems.

BACKGROUND OF THE INVENTION

There are known key switches, comprising a housing, an actuation key, a switching member and a means for returning the key into its initial position. With switches of this kind manual input of information involves acting upon the key to move the movable part of the switch, thus acting upon the switching member to make or to break the external electric circuit. Depending on the actual application of the key switch, it may have for its switching member various contact and contact-free devices, e.g. sealed-contact reed relays, inductance or capacitance transducers, photoelectric or magnetically responsive switches, and so on. The means for returning the key into its initial position in most cases is in the form of a compression spring which is subjected in operation to two-sided resilient deformation and thus curbs down the service life of the key switch, whereas the mechanical characteristic of this switch (i.e. the curve of the distribution of the static load vs. the stroke of the key) defined by the compression of the spring and featuring the rising resistance to the displacement of the key would not promote the positive actuation of the key to its required extreme or endmost position, while affecting the vibration-proof rating of the key switch and not giving the operator a distinct "feel" of the key switch having operated, i.e. of the area where the switching member is actuated; in other words, the required reliability of the input of information is not provided for in full.

There is known a key switch (cf.USSR Inventor's Certificate No. 409,302; Int.Cl.$^2$ H01H 13/28, dated Dec. 30, 1973) comprising a housing, an actuation key rigidly connected with a permanent magnet or several permanent magnets accommodated in the housing, a magnetically responsive switching member mounted in the housing and adapted to be acted upon by the permanent magnet or magnets as the key is displaced, means for retaining the key in its initial position, including a plate of a soft-magnetic material mounted in the housing intermediate the key and the magnet or magnets, and means for returning the key into its initial position, including a compression spring.

As compared with the first-mentioned type of key switches, the abovedescribed key switch offers an improved vibration-proof rating and the reliability enhanced by the incorporation of the key-retaining means. However, the presence of the compression key-returning spring still affects the service life or durability of the key switch, complicates its structure and would not provide for having an ergonomically attractive mechanical characteristic promoting error-proof input of information.

SUMMARY OF THE INVENTION

It is an object of the present invention to create a key switch which should provide for a high reliability of the input of information, and which should have simple structure and enhanced durability.

This and other objects are attained in a key switch comprising a housing accommodating therein at least one permanent magnet rigidly connected with the actuation key and adapted to act, as the key is displaced, upon a switching member fixed in the housing, means retaining the key in its initial position, including a plate of a ferromagnetic material secured in the housing intermediate the key and the magnet, and means for returning the key into its initial position, secured in the housing, in which key switch, in accordance with the present invention, the means for returning the key into its initial position includes at least one plate of a ferromagnetic material, arranged in the direction of the motion of the key with a gap relative to the permanent magnet and defining jointly with the plate of the key-retaining means a magnetic circuit, the length of this at least one plate in the direction of the motion of the key being short of the sum total of the maximum displacement of the key and the length of the permanent magnet in this direction.

It is expedient that in a key switch embodying the present invention the plates of the key-returning means should be made integral with the plates of the key-retaining means.

It may be further expedient in a key switch embodying the present invention that, with the key-returning means including three plates, there should be two permanent magnets facing each other by their opposite poles and mounted with a gap left between these opposite poles, one plate of the key-returning means being received in this gap and the two remaining plates being arranged adjacent to the respectively other poles of the permanent magnets.

The disclosed key switch provides for high reliability of input of information, owing to its mechanical characteristic featuring the depression effort which diminishes as the key is being depressed further down and thus minimizing the probability of the key not being depressed into its operating position; furthermore, this gives the operator the "feel" or "touch" of the operating zone of the switch.

Moreover, the springless returning of the key into its initial position simplifies the structure of the key switch and substantially enhances its durability.

SUMMARY OF THE DRAWINGS

The present invention will be further described in connection with its embodiments, with reference being made to the accompanying drawings, wherein.

DISCLOSURE OF THE INVENTION

Figure 1:
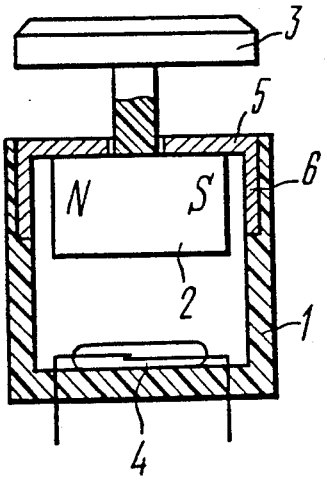
FIG. 1 is a longitudinally sectional view of a key switch embodying the invention.

The key switch comprises a housing 1 (FIG. 1) of a diamagnetic material, e.g. of plastic. The housing 1 accommodates at least one permanent magnet which in the presently described embodiment is a permanent magnet 2 rigidly connected with the actuation key 3, e.g. a plastic one. The permanent magnet 2 and the key 3 form the movable part of the key switch, reciprocable in the guideways (not shown in the drawing) provided in the housing 1.

Figure 2:
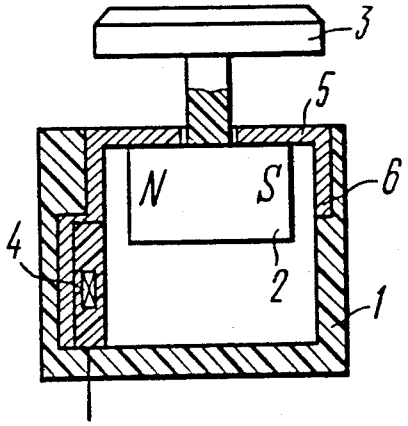
FIG. 2 shows the same as FIG. 1, with a magnetically responsive switching member and a modified means for returning the key into its initial position, in accordance with the invention.
Figure 3:
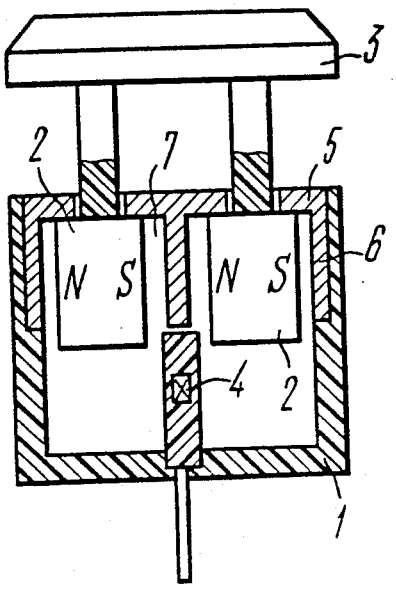
FIG. 3 is a longitudinally sectional view of a key switch with two permanent magnets and the key-returning means including three plates, in accordance with the invention.

With the movable part being depressed, the permanent magnet 2 acts upon the switching member 4 secured in the housing 1. Depending on the actual application of the key switch and the field of its use, the switching member can be a sealed-contact reed relay (FIG. 1), or else other kinds of magnetically responsive switching means or transducers (FIGS. 2 and 3). In every embodiment of the herein disclosed key switch the switching member 4 is accommodated in the housing 1 in the area of action of the magnetic field of the permanent magnet 2, as the latter is displaced to the zone of operation of the switch, the permanent magnet 2 being indexed to correspond to the operating mode of the switching member 4.

The key switch further includes a means 5 (FIG. 1) for retaining the key 3 in its initial position, including a plate of a ferromagnetic material secured in the housing 1 intermediate the key 3 and the permanent magnet 2. The housing 1 further accommodates the means for returning the key into its initial position, including at least one plate of a ferromagnetic material arranged in the direction of the reciprocation of the key 3 with a gap relative to the permanent magnet 2 and defining a magnetic circuit jointly with the plate of the key-retaining means 5.

In the embodiment being described the means for returning the key 3 includes two ferromagnetic plates 6, the length of at least one plate 6 in the direction of the reciprocation of the key 3 being short of the sum total of the maximum displacement of the key 3 and the length or extent of the permanent magnet 2 in this direction. In the embodiment illustrated in FIG. 1 the two plates 6 are of the same length.

The embodiment of the herein disclosed key switch, illustrated in FIG. 2, is similar to the embodiment described above.

The difference of the embodiment of FIG. 2 resides in that one of the plates 6 has a length in excess of the abovespecified predetermined minimum length. This is explained by the fact that the magnetically responsive transducer incorporated in this embodiment of the invention operates reliably when the magnetic flux is concentrated at its responsive surface.

The embodiment of the herein disclosed key switch, illustrated in FIG. 3, is generally similar to the embodiment of FIG. 2.

The difference resides in that the means for returning the key 3 into its initial position includes three plates 6. In this embodiment, there are two permanent magnets 2 facing each other by their respective opposite poles and arranged with a gap 7 left between these opposite poles. One of the plates 6 (the central one) is received in this gap 7, while the remaining two plates 6 (the endmost ones) are arranged adjacent to the other respective poles of the permanent magnets 2.

In this embodiment, all the plates 6 are of the same length, while the magnetically responsive switching member 4 is situated in the zone of the maximum concentration of the magnetic flux produced by the two permanent magnets 2.

To simplify the structure of the key switch, in all the abovedescribed embodiments the plates of the key-retaining means 5 are integral with the respective plates 6 of the means for returning the key 3 into its initial position.

Furthermore, depending on the intended application of the key switch and its manufacturing technology, the plates of the key-retaining means and the components of the key-returning means can be made either of a soft-magnetic material or of a hard-magnetic one.

The disclosed key switch operates, as follows. In the initial position of the key switch the permanent magnet 2 (FIG. 1) is attracted to the ferromagnetic plate of the key-retaining means 5, and their magnetic interaction ensures reliable retaining of the key 3 in the initial or undepressed position. In this state, the permanent magnet 2, the plate of the key-retaining means 5 and the plates 6 of the means for returning the key 3 define a closed magnetic circuit or system wherein the magnetic flux is closed via these plates, whereas the switching member 4 is beyond the field of action of this major magnetic flux. Furthermore, in this state of the key switch the propagation of the leakage magnetic field into the surrounding space is virtually eliminated, which prevents the adverse action of this leakage field upon adjoining devices.

When the key 3 is depressed, first, the effort of attraction of the permanent magnet 2 to the plate of the key-retaining means 5 is to be overcome, and then the permanent magnet 2 is moved axially of the switch. When the permanent magnet 2 leaves the zone of the plates 6, the direction of the closing of the magnetic flux changes, so that this flux acts intensely upon the switching member 4. At the same time, the resistance to the depression of the key 3 sharply drops, so that the operator gets the "feel" of the operating zone of the switch, whereby his feeling of touch sends to him a signal representative of the completion of the operation of feeding in the information.

With the key 3 released, the magnetic interaction of the permanent magnet 2 with the plates 6 of a ferromagnetic material, located in the zone of the propagation of the magnetic flux, and its further interaction with the plate of the key-retaining means 5 return the key 3 into its initial position. The rising of the permanent magnet 2 from its downmost position is provided for under the condition that the length of the plates 6 is short of the sum total of the maximum displacement of the key 3 and of the length or extent of the permanent magnet 2 in the direction of the reciprocation of the key 3, because when this condition is satisfied, there are applied to the permanent magnet 2 the vertical components of the forces of magnetic interaction, directed upwardly.

The operation of the key switch illustrated in FIG. 2 is similar to the one described above. The operation of the embodiment illustrated in FIG. 3, although also generally similar, differs in that there is produced in the gap 7 between the two permanent magnets 2 a total magnetic flux of considerable uniformity, which allows for using low-response magnetically actuated transducers as the switching members, as well as for making permanent magnets of a material with reduced energy ratings.

What we claim is:

1. A key switch comprising:

a housing;

a permanent magnet accommodated in said housing;

a key rigidly connected with said permanent magnet for reciprocation therewith relative to said housing;

a switching member secured in said housing to be acted upon by said permanent magnet as said key is displaced;

a plate of a ferromagnetic material defining a means for retaining said key in its initial position, secured in said housing intermediate said key and said permanent magnet;

at least one plate of a ferromagnetic material, arranged in said housing in the direction of reciprocation of said key, with a gap relative to said permanent magnet, defining a magnetic circuit with said plate of said key-retaining means and defining a means for returning said key into the initial position thereof, the length of said at least one plate of said key-returning means in the direction of reciprocation of said key being short of the sum total of the value of the maximum displacement of said key and the extent of said permanent magnet in this direction.

2. A key switch as set forth in claim 1, wherein said plates of said key-retaining means and said key-returning means are made integral with each other.

3. A key switch comprising:

a housing;

two permanent magnets accommodated in said housing with their respective opposite poles facing each other and with a gap left between these poles;

a key rigidly connected with said permanent magnets for reciprocation therewith relative to said housing;

a switching member secured in said housing to be acted upon by said permanent magnets as said key is displaced;

a plate of a ferromagnetic material defining a means for retaining said key in its initial position, secured in said housing intermediate said key and said permanent magnets;

three plates of a ferromagnetic material, arranged in said housing in the direction of reciprocation of said key, defining a magnetic circuit jointly with said plate of said key-retaining means, and defining a means for returning said key into the initial position thereof, one of said three plates being received in said gap between said respective opposite poles of said permanent magnets, and the remaining two plates of said three plates being situated adjacent to the respective other poles of said magnets, with a gap relative to said poles, the length of at least one of said three plates in the direction of reciprocation of said key being short of the sum total of the value of the maximum displacement of said key and the extent of the respective one of said permanent magnets in this direction.

4. A key switch as set forth in claim 3, wherein said plates of said key-retaining means and said key-returning means are made integral with each other.

* * * * *